United States Patent [19]

Hutson et al.

[11] 4,390,132

[45] Jun. 28, 1983

[54] WOOD CHIPPER

[75] Inventors: Marvin R. Hutson; Louis G. Dutmers, both of Remus, Mich.

[73] Assignee: Omark Industries, Inc., Portland, Oreg.

[21] Appl. No.: 232,696

[22] Filed: Feb. 9, 1981

[51] Int. Cl.[3] ..... B02C 18/16

[52] U.S. Cl. ..... 241/55; 241/79; 241/92; 241/101.7

[58] Field of Search ..... 144/176; 241/55, 56, 241/57, 79.1, 79, 101.7, 92, 292.1, 296, 297, 298

[56] References Cited

U.S. PATENT DOCUMENTS

| | | | |
|---|---|---|---|
| 2,422,399 | 6/1947 | Erickson | 241/79 X |
| 3,861,602 | 1/1975 | Smith | 241/92 |
| 4,057,192 | 11/1977 | Smith | 241/92 |
| 4,078,590 | 3/1978 | Smith | 241/92 X |

*Primary Examiner*—Mark Rosenbaum

*Attorney, Agent, or Firm*—Barnes, Kisselle, Raisch, Choate, Whittemore & Hulbert

[57] ABSTRACT

A tree is received on a guide and fed toward a rotating disc by a feed roller carried by an arm. The arm pivots to increase the force with which the feed roller engages the tree as the resistance to feeding the tree into the rotating disc increases. Wood chips are cut from the tree by a blade on the rotating disc which slopes upwardly across and generally in the direction of the feed of the tree. The wood chips pass through the disc and into pockets from which the chips are discharged through a duct. The wood chips are also propelled through the duct by an airstream produced by fan blades on the back of the disc. To separate debris from the wood chips as they are cut from the tree, the disc is received in a housing which extends above the disc and a discharge duct communicates with the housing above the upper face of the disc.

23 Claims, 12 Drawing Figures

3
20
32
36
38
140
142
50
22
40
144
138
162
146
134
126
124
132
176
9
122
114
116
130
192
150
152
164
136
148
128
160
154
166
184
180
178
118
156
112
120
A
94
90
88
92
96
84
80
82
26
48
104
108
110
60
106
62
72
28
70
78
102
74
58
100
98
86
30

WOOD CHIPPER

This invention relates to producing chips of wood and more particularly, to a device for reducing felled trees, limbs, brush, branches, and the like to small chips of wood.

Chips of wood are used both for fuel and as raw material for pulp and paper mills. Wood chips for pulp and paper mills should be of uniform size and clean or free of debris. Hence, when reducing trees to produce wood chips for pulp and paper mills, bark, dirt, sand, leaves, twigs, and other debris should be separated and removed from the wood chips.

Several devices for reducing trees to wood chips have been previously developed. In these devices, the butt end of the tree is supported on an anvil adjacent rotating knives which cut the tree into wood chips. In many of these devices, the tree is fed into the knives by complex conveyor and feed roller mechanisms which require great power to feed the tree. There is a tendency for the tree to become jammed or hung up in these feed mechanisms or between the anvil and the knives. In these devices, the bark and other debris is not adequately separated from the wood chips.

In accordance with this invention, wood chipping knives are carried by a disc having its front face extending across and sloping upwardly and generally in the direction of feed of the tree. The wood chips pass through the disc into a pocket on the back face of the disc from which they are discharged into a duct. The wood chips are also propelled through the chute by an airstream produced by fan blades on the rear face of the disc. If desired, fine particles can be removed from the stream of wood chips by a separator disposed in the chute.

To separate bark and other debris from the wood chips, a discharge duct communicates with the side wall of a housing which encircles and extends above the upper face of the disc. Preferably, a tree is fed into the knives by a feed roller mounted on a carrier arm which is pivoted above the tree and upstream from the point of engagement of the roller with the tree so that the force produced by the roller to feed the tree increases as the resistance to feeding the tree increases.

Objects, features, and advantages of this invention are to provide a wood chipper which eliminates jamming of the tree in the blades and the feed mechanism, eliminates a tree supporting anvil, increases cutting efficiency, improves feeding of the tree into the knives, produces an increasing feeding force as resistance to feeding of a tree increases, improves separation of bark and other debris from the wood chips, provides an unrestricted entery for trees into the knives to facilitate feeding of trees with wide branches, has a compact and narrow in-line arrangement of its components to provide a portable device carried by a trailer or vehicle for use on conventional highways, narrow lanes, and the like, and which is rugged, durable, of simplified design, of economical manufacture and assembly, and easily serviced and maintained.

These and other objects, features, and advantages of this wood chipper will be apparent from the following detailed description, appended claims, and accompanying drawings in which:

Figure 1:
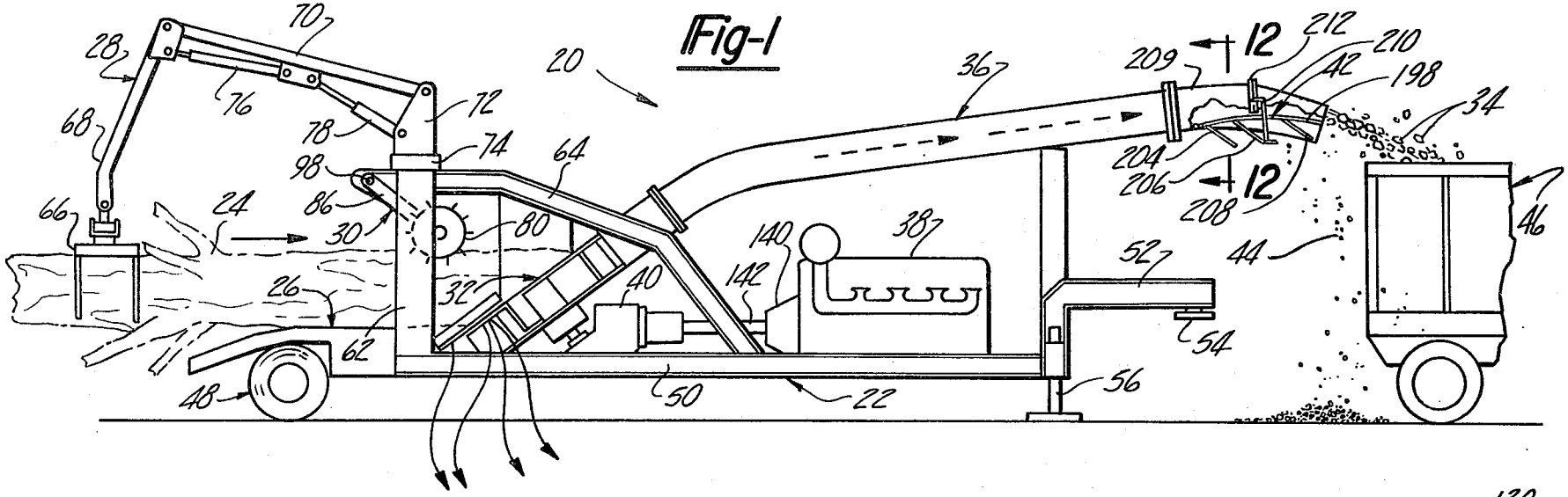
FIG. 1 is a side view of a portable wood chipper embodying this invention.
Figure 6:
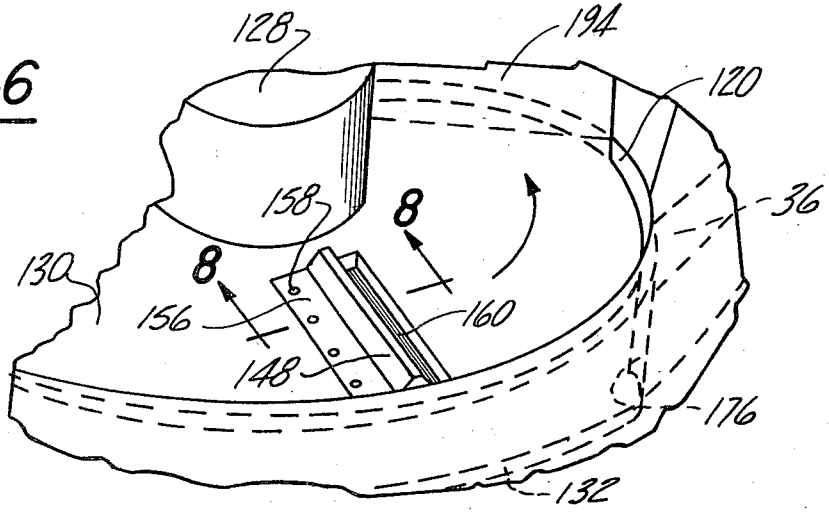
FIG. 6 is an enlarged and fragmentary perspective view of a knive and the rotor of the wood chipper of FIG. 1.
Figure 2:
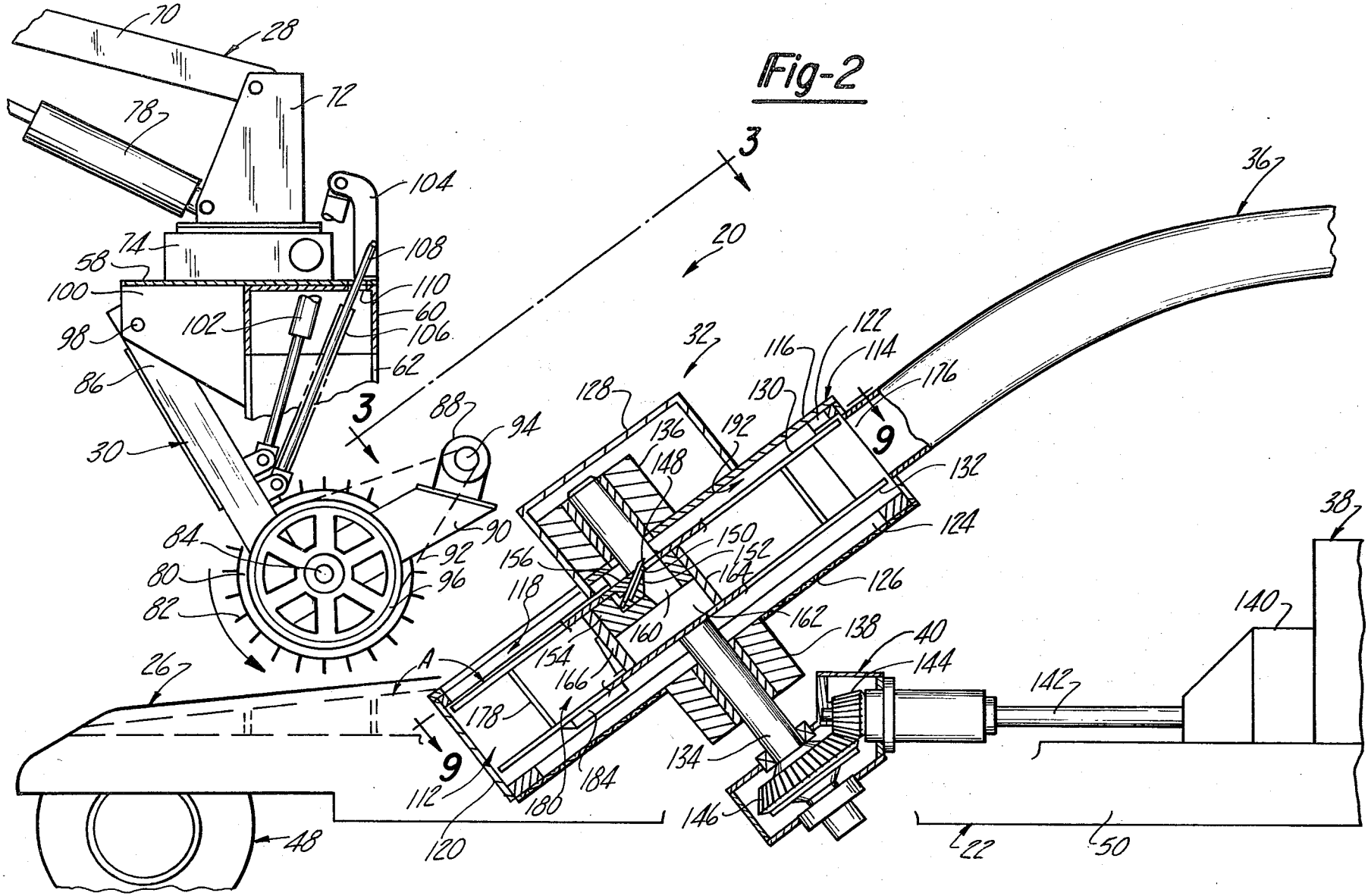
FIG. 2 is an enlarged fragmentary side view with portions broken away of the wood chipper of FIG. 1.

Referring in more detail to the drawings, FIGS. 1 and 2 illustrate a portable wood chipper 20 embodying this invention carried by a trailer 22. The trunk of a tree 24 is placed in a guide chute 26 by a loader 28 and advanced by a feed assembly 30 into a chipper assembly 32 from which wood chips 34 are discharged through a duct 36. The chipper assembly 32 is driven by a diesel engine 38 through a gear box 40. A separator assembly 42 removes fine wood particles 44 from the stream of wood chips 34 which may be discharged into the box of a truck 46.

Trailer 22 has a wheel and axle assembly 48 mounted on the rear end of a frame 50 having a tongue 52 and hitch 54 at its front end. When the trailer is detached from a towing vehicle, its front end is supported on the ground by a pair of laterally spaced apart stabilizers 56 which may be hydraulically extended and retracted. The loader 28 is mounted on a plate 58 fixed to a crossbeam 60 (FIG. 4) fixed to the upper ends of a pair of laterally spaced apart posts 62, each fixed at its lower end to the frame 50. The posts are also supported by braces 64 fixed to the posts and the frame.

Loader 28 has a grapple 66 pivotally connected to one end of a lower arm 68, the other end of which is pivotally connected to one end of an upper arm 70, the other end of which is pivoted in a housing 72. Housing 72 is mounted by a suitable bearing to swivel on a base 74 secured to plate 58. Arms 68 and 70 are actuated by hydraulic cylinders 76 and 78 and the jaws of grapple 66 are opened and closed by hydraulic cylinders (not shown). Since the construction and operation of the loader 28 may be conventional, it will not be described in further detail.

Figure 5:
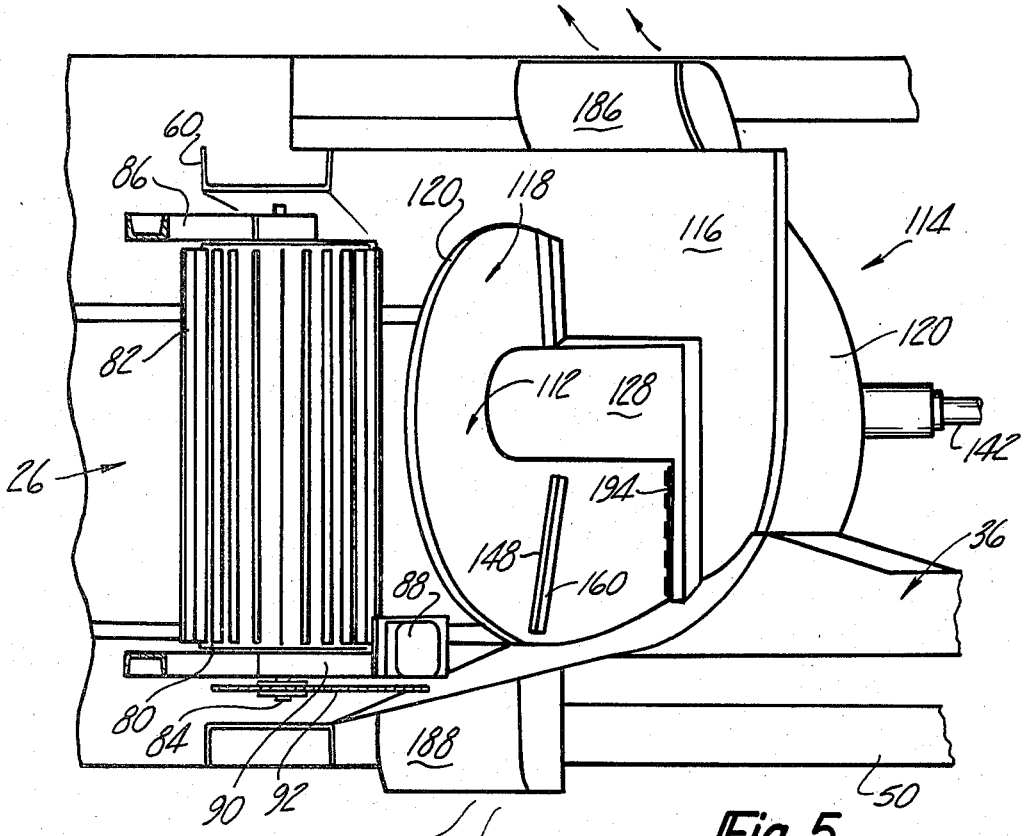
FIG. 5 is an enlarged and fragmentary top view of the wood chipper of FIG. 1.

In accordance with one feature of this invention, the tree 24 is readily positioned and fed into the chipper assembly 32 with essentially unrestricted access to the chipper by cooperation of the chute 26 and the feed assembly 30. As shown in FIGS. 2 and 5, the feed assembly has a feed roll 80 with a plurality of circumferentially spaced gripper bars 82 thereon. The feed roll 80 is secured to a shaft 84 journaled for rotation adjacent the lower end of a pair of laterally spaced apart carrier arms 86. Feed roll 80 is driven counterclockwise (as viewed in FIG. 2) by a hydraulic motor 88 secured to a mounting strut 90 fixed to one of the carrier arms 86. Motor 88 is operably connected to roll 80 by a chain 92 and sprockets 94 and 96.

In accordance with another feature of this invention, the force applied by the roll 80 to feed a tree into the chipper assembly 32 increases with increasing resistance to feeding of the tree because the pivots 98 for the carrier arms 86 are located above and upstream from the point at which the roll 80 engages the tree 24. This assures that increased resistance to the feed of the tree will result in the roll 80 being pivoted downwardly with increased force into firmer engagement with the tree so that the roll will not slip. The pivots 98 for the carrier arms 86 are secured to gussets 100 fixed to the plate 58 and the posts 62. The feed roll 80 is moved out of and forced into engagement with the tree by a hydraulic cylinder 102 with its rod and housing pivotally connected to one of the arms 86 and a mounting bracket 104 respectively. To increase the force urging the roll 80 into engagement with a large diameter tree which raises the carrier arms 86, a compression spring 106 is received over a guide rod 108 having one end pivotally connected to one of the arms 86 and the other end extending through a hole 110 in the cross beam 60.

As shown in FIGS. 2-5, chipper assembly 32 has a rotor 112 mounted in a housing 114 with a cover 116 having a large access opening 118 through which a tree can extend to engage the rotor. The housing 114 has a side wall 120 which encircles and lies closely adjacent to the rotor. The side wall 120 is reinforced by metal rings 122 and 124. A coarse screen 126 is fixed to the bottom of the housing and a bearing cap 128 is secured to the cover.

Rotor 112 has upper and lower discs 130 and 132 fixed to a central hub (FIG. 9) which is secured to a shaft 134. The shaft 134 is journaled for rotation in bearings 136 and 138 fixed to the cover 116 and ring 126 respectively.

In accordance with another feature of this invention, jamming of the butt of the tree in the chipper assembly and the tree supporting anvil are eliminated by mounting the rotor 112 so that the upper face of the disc 130 extends across and slopes upwardly in generally the direction of the feed of the tree, and driving the rotor in the direction of rotation which tends to lift the leading end of the tree generally upward off the guide chute 26 and into engagement with the feed roll 80. Preferably, the plane of disc 130 is inclined to the longitudinal axis or line of feed of the tree at an obtuse included angle (A in FIG. 2) which may be in the range of about 125° to 160°, is desirably in the range of 136° to 148° and is preferably about 142°.

Figure 4:
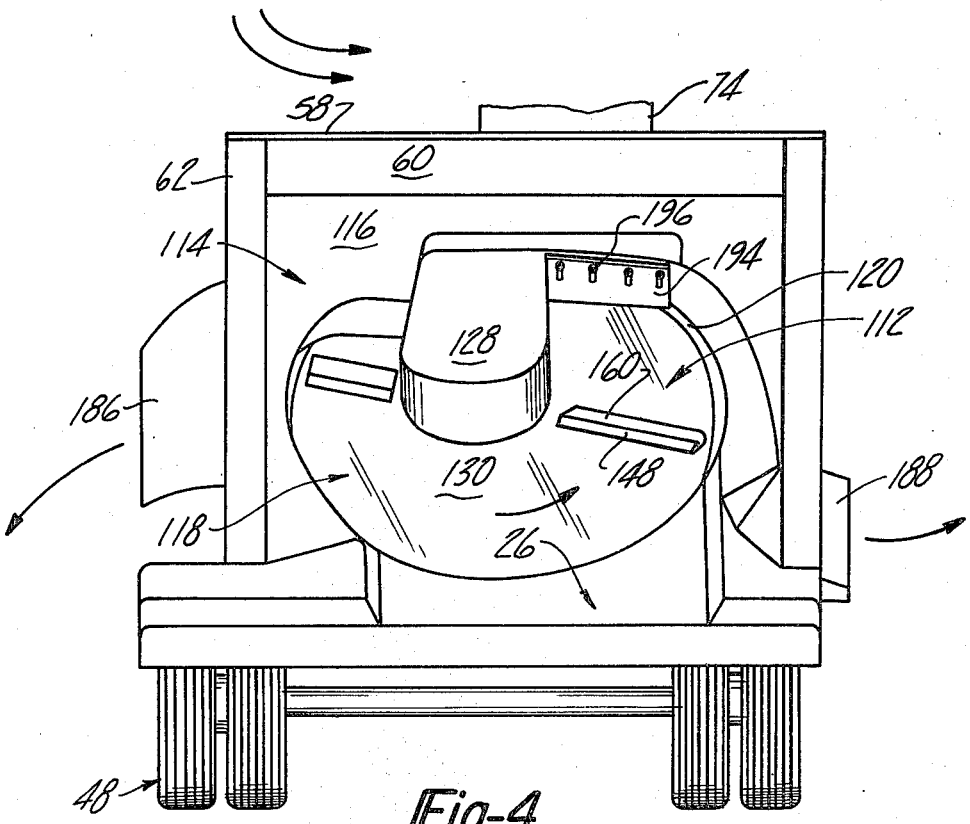
FIG. 4 is a fragmentary end view of the wood chipper of FIG. 1.

As shown in FIG. 4, when viewed from the rear of the device 20, if the tree engages the right hand side of the rotor 112, it should be rotated counterclockwise. However, if device 20 were constructed so that when viewed from the rear, the tree engaged the left hand side of the rotor 112, it should be rotated clockwise. The rotor 112 is driven counterclockwise (as viewed in FIGS. 4 and 5) by the engine 38 through a clutch assembly 140, and a drive shaft 142 connected to a bevel gear 144 in the gear box 40 which meshes with a bevel gear 146 coupled to the lower end of the shaft 134.

Figure 3:
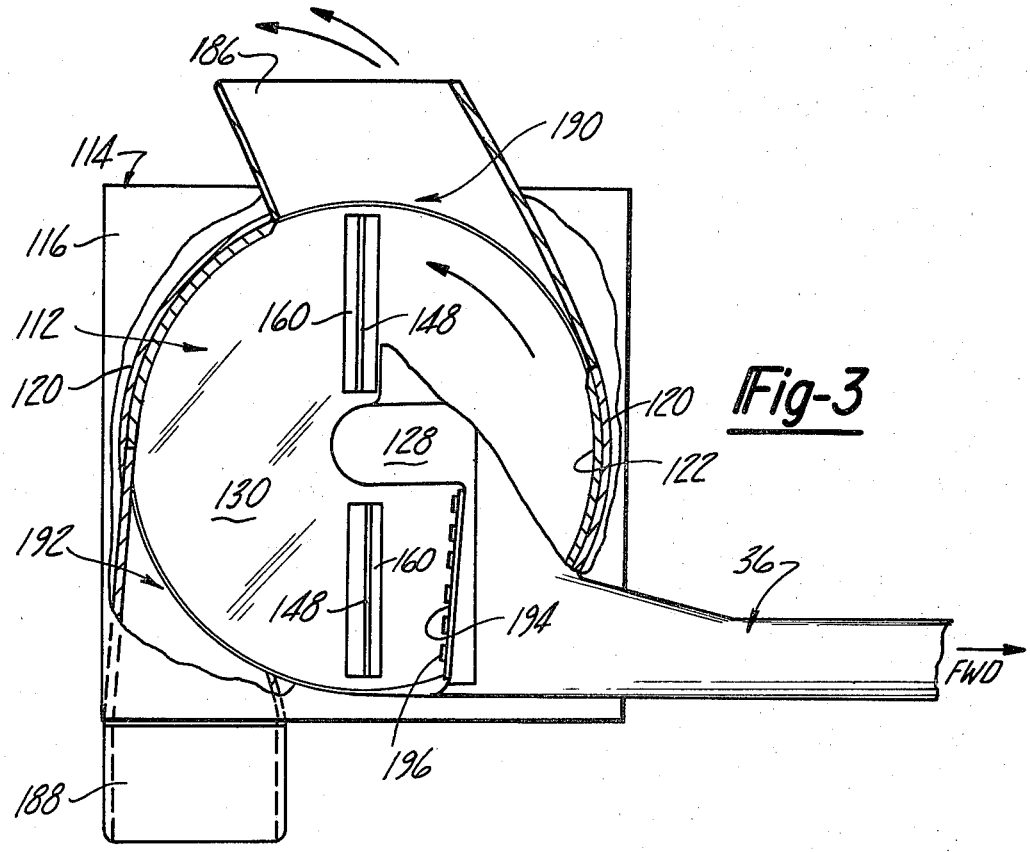
FIG. 3 is a fragmentary view with portions broken away taken generally on a line 3—3 in FIG. 2.
Figure 8:
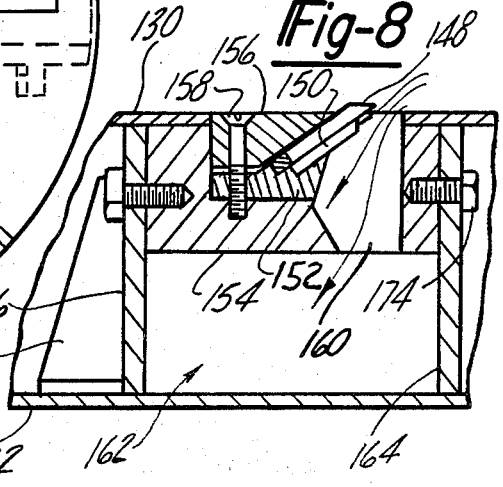
FIG. 8 is a sectional view taken generally on line 8—8 of FIG. 6.

A plurality of cutting knives are carried in equally circumferentially spaced apart relationship by the rotor 112. As shown in FIGS. 3 and 4, preferably, two or more cutting knives 148 are mounted in diametrically opposed relation on the disc 130. As shown in FIG. 8, each cutting knive 148 and an underlying chip breaker 150 are received in a seat 152 and secured in a holder block 154 by a clamp 156 and cap screws 158. As each knife 148 cuts a slice of wood from the tree 24, the slice passes into an opening 160 and is broken into wood chips by breaker 150 and the leading edge of the seat 152.

Figure 7:
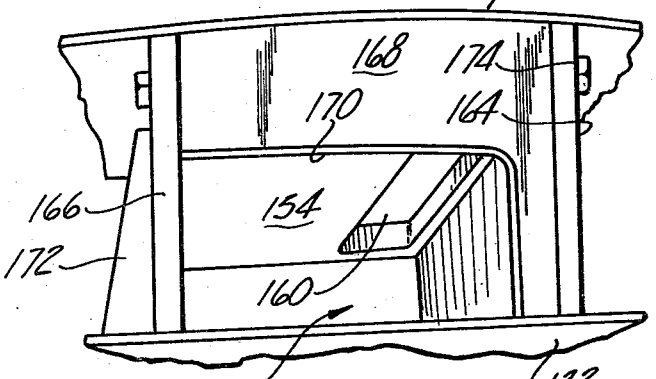
FIG. 7 is an enlarged fragmentary perspective view of a chip pocket of the rotor of the wood chipper of FIG. 1.
Figure 9:
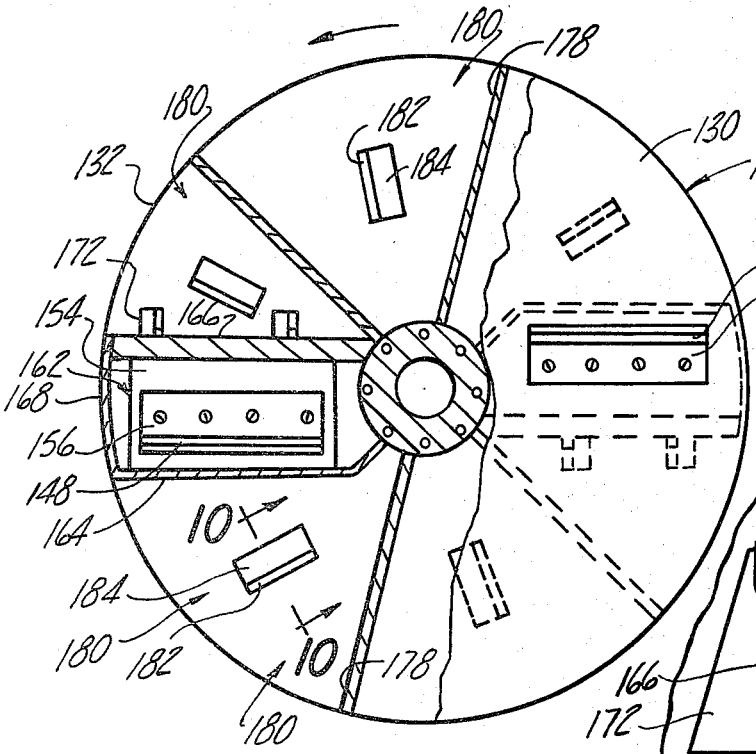
FIG. 9 is a sectional view with portions broken away taken generally on line 9—9 of FIG. 2.

In accordance with a further feature of this invention, the wood chips are initially received in a pocket 162 underlying each knife 148, discharged by centrifugal force into duct 36, and propelled through the duct at least in part by an airstream. As shown in FIGS. 7-9, each pocket 162 is defined by the cooperation of side walls 164 and 166, and an outer end wall 168 with an outlet 170 therein. The side and end walls are fixed to both of the discs 130 and 132 and the side wall 166 is reinforced by gussets 172. The knife holder block 154 is secured to the side walls by bolts 174.

Figure 10:
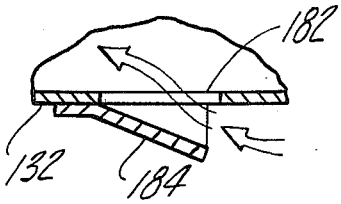
FIG. 10 is a sectional view taken generally on line 10—10 of FIG. 9.

The wood chips are prevented from passing out of the pockets 162 by the housing side wall 120, except when they overlap the inlet opening 176 to the duct 36. The airstream through the duct 36 is produced by a plurality of radially extending blades 178 received between and fixed to the discs 130 and 132, to define blower pockets 180 to which air is admitted through an inlet 182 and an air scoop 184 (FIG. 10) fixed to the bottom of the disc 132.

In accordance with this invention, bark, twigs, sand, and other debris separates from the wood being cut from the tree 24 by the knives 148, falls onto the upper face of the disc 130, and usually is discharged by centrifugal force through ducts 186 and 188. As shown in FIGS. 2 and 3, to confine the debris, the housing side wall 120 extends above the upper face of the disc preferably at least about two inches. The ducts 186 and 188 each communicate with only the space above the chipper disc 130 through openings 190 and 192 respectively in the portion of the housing side wall 120 which extends above the disc.

When reducing trees to produce fuel, it is usually desirable to mix the bark with the wood chips. This can be accomplished by blocking off openings 190 and 192 with suitable gates (not shown) and lowering a slide 194 (FIG. 4) which is releasably secured by cap screws 196 to the housing 114. Preferably, the slide 194 is lowered as shown in FIG. 4, so that there is only a slight clearance (about $\frac{1}{4}$ to $\frac{1}{2}$ inch) between the slide and the tip of the knives 148. This traps the bark on the chipper disc 130 so that it passes through openings 160 and into the pockets 162 from which it is discharged into duct 36 along with the wood chips. When the bark is to be separated from the wood chips, the slide 194 is raised to provide substantial clearance (preferably about two inches) between the slide and the tips of the knives 148.

Figure 11:
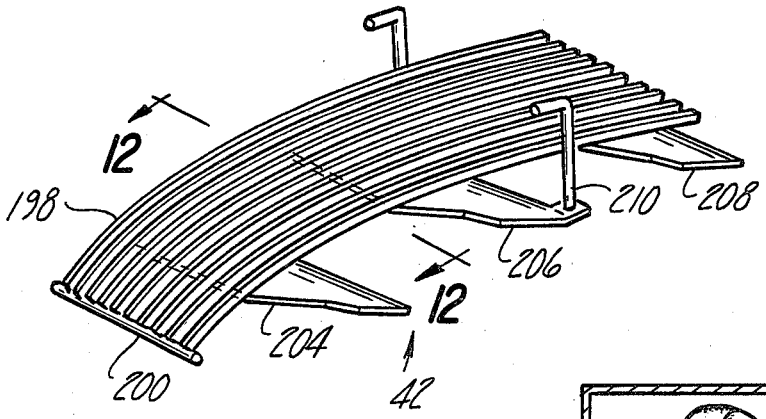
FIG. 11 is a perspective view of a fines separator of the wood chipper of FIG. 1.
Figure 12:
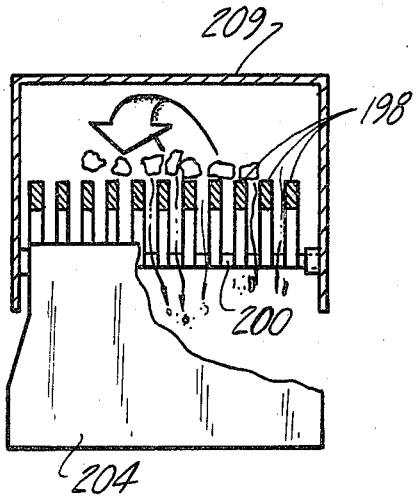
FIG. 12 is a sectional view taken generally on line 12—12 of FIGS. 1 and 11.

In accordance with another feature of this invention, separator 42 removes fine particles from the stream of wood chips 34 being discharged from the duct 36. As shown in FIGS. 11 and 12, separator 42 has a plurality of equally spaced apart arcuate rails 198, each fixed at one end to a pivot shaft 200. To deflect fine particles passing between the rails 198, three longitudinally spaced apart baffle plates 204, 206, and 208 are fixed to and depend from the walls. As shown in FIGS. 1 and 12, the separator 42 is pivotally mounted by shaft 200 in an outlet hood 209 which swivels on the end of the duct 36 and does not have any bottom wall.

When the separator 42 is raised to the position shown in FIG. 1, the larger wood chips impinge on and ride over the rails 198 while fine particles pass through the rails and are deflected downwardly by the baffles 204, 206, and 208. As the airstream passes through the separator, the baffles create a venturi effect which also tends to separate the relatively light weight and fine particles from the wood chips. The separator 42 can be releasably retained in any desired position in the hood 209 by carrier rods 210 which have one end fixed to the baffle 206 and the other end releasably engaged with retainers 212 on the hood 209. The separator 42 can be deactivated by pivotly moving the rails 198 so that they do not project into the stream of air and wood chips.

To operate the wood chipper 20, engine 38 is started and clutch 140 engaged to drive the rotor 112 of the chipper assembly 32 and a hydraulic pump (not shown) to supply hydraulic fluid to the various cylinders. A tree 24 is loaded on the chute 26 by the loader 28. The loader 28 is operated by manipulating control valves (not shown) to supply hydraulic fluid under pressure to cylinders 76 and 78 and the cylinders actuating the grapple 66. The tree 24 is advanced by the feed assembly 30 through the chute 26 so that its butt end engages the rotor 112 of the chipper assembly 32. The roll 80 of the feed assembly 30 is moved downward and forced into engagement with the tree by actuating hydraulic cylinder 102 and the roll is rotated to advance the tree toward the rotor 112 by energizing the hydraulic motor 88. With larger diameter trees, the feed roll 80 is also urged into firm engagement with the tree by the compression spring 106.

When the tree 24 engages the rotor 112, a slice of wood is cut off by each knife 148 as it is swept by the rotor across the butt end of the tree. Each slice of wood passes generally downwardly through the opening 160 in the holder block 154, and is broken into wood chips when it strikes the chip breaker 150 and the leading edge of the tool seat 152. The wood chips pass into the associated pocket 162 from which they are discharged due to centrifugal force when the rotor 112 has turned sufficiently so that the pocket outlet 170 overlaps the inlet 176 of the discharge duct 36.

The bark and other debris which are removed from the tree 24 as each slice of wood is cut fall onto the front face of the disc 130 of the rotor 112. Usually this bark and debris are propelled by centrifugal force imparted by the rotor through discharge chutes 186 and 188. However, if it is desired to include the bark with the wood chips, such as when reducing a tree for fuel, the inlets 190 and 192 of the ducts 186 and 188 can be blocked off by gates (not shown) and the slide 194 lowered to the position shown in FIG. 4. This entraps the bark in the space above the rotor 112 so that it will pass through the openings 160 and into the pockets 162 from which the bark will be discharged by centrifugal force along with the wood chips through the duct 36.

To separate the fine particles from the stream of the wood chips 34 discharged from the duct 36, the separator 42 is raised to the position shown in FIG. 1 so that its rails 198 extend into the stream of air and wood chips being discharged from the duct through the outlet hood 209. This causes the fine particles 44 to pass between the rails 198 and be deflected downwardly out of the bottom of the hood by the baffles 204, 206 and 208 while the relatively larger wood chips 34 pass over the rails and are discharged from the outlet end of the hood. A portion of the air stream also flows between the baffles, thereby creating a venturi effect which tends to separate and remove the fine particles 44.

We claim:

1. Apparatus for reducing material such as felled trees, limbs, branches, and brush to chips comprising means underlying for carrying and guiding such material forwardly in a generally linear path to a work station, a rotor in said work station having a chipper disc with its front face lying in said feed path, means mounting said rotor to rotate about an axis such that the portion of said front face of said disc which engages such material extends across the feed path and slopes upwardly generally in the direction of the forward feed of such material at an obtuse included angle between said portion of said front face and said direction of feed in the range of about 125° to 160°, at least one knife disposed generally radially on and carried by said disc for cutting such material into chips as said chipper disc rotates, and drive means constructed and arranged to rotate said rotor in the one direction of rotation in which said knife is swept across the leading end of such material so that the leading end of such material tends to be lifted from said means for guiding such material and moved in generally the same direction in which such material is forward fed along said path toward said rotor.

2. The apparatus of claim 1 which also comprises a material feeder having a pendent carrier member mounted to pivot on an axis about the feed path of such material and upstream of the point at which such material engages said rotor, an endless driven member carried by said carrier member and constructed and arranged to engage such material at a point along said feed path which is below and downstream of said pivot point of said carrier member and upstream of and adjacent to the point of engagement of such material with said chipper disc, and means constructed and arranged to drive said driven member so that such material is advanced along such feed path toward said rotor, whereby, as the resistance to forward feeding of such material increases, the force with which such driven member engages such material also increases.

3. The apparatus of claim 2 wherein said endless driven member comprises a roll and said means driving said endless driven member is also carried by said pendent carrier member.

4. The apparatus of claim 1 wherein said disc has an opening there through adjacent each knife, said rotor has means defining a chip pocket underlying said chipper disc, communicating with said opening and constructed and arranged to receive chips of such material cut by said knife, said chip pocket having an outlet adjacent the radial outer portion thereof and said apparatus also comprising a rotor housing having a wall encircling said rotor, lying closely adjacent said outlet of said chip pocket essentially throughout the circumferential extent of said wall, and extending generally axially at least across the generally axial extent of said outlet of said pocket, and a discharge duct having an inlet opening through said wall of said housing and constructed and arranged such that said inlet, at least in part, overlaps said outlet of said chip pocket when said rotor turns to sweep said outlet past said inlet so that at least a portion of any chips in said chip pocket are propelled by centrifugal force through said outlet of said chip pocket and into said discharge duct.

5. The apparatus of claim 4 wherein said rotor also comprises at least one generally radially and axially extending fan blade underlying said chipper disc and constructed and arranged to produce a stream of air flowing through said discharge duct in response to rotation of said rotor.

6. The apparatus of claim 5 which also comprises a wall encircling said chipper disc, lying closely adjacent thereto and extending generally axially above said front face of said chipper disc, and at least one debris discharge duct having an inlet opening into said wall generally axially above the back face of said chipper disc and being constructed and arranged such that debris from the material being reduced falls onto said chipper disc and is propelled by centrifugal force into said debris discharge duct.

7. The apparatus of claim 4 wherein said rotor also comprises a second disc axially spaced apart from and underlying said chipper disc, a plurality of circumferentially spaced apart and generally axially and radially extending fan blades received between said discs and constructed and arranged to define, in cooperation with said discs, a plurality of blower pockets in said rotor, an air inlet associated with each blower pocket and an opening through said second disc, whereby rotation of said rotor produces an air stream flowing through said discharge duct.

8. The apparatus of claim 4 which also comprises a wall encircling said chipper disc, lying closely adjacent thereto and extending generally axially above said front face of said chipper disc, and at least one debris discharge duct having an inlet opening into said wall generally axially above the back face of said chipper disc and being constructed and arranged such that debris from the material being reduced falls onto said chipper disc and is propelled by centrifugal force into said debris discharge duct.

9. The apparatus of claim 4 wherein said wall encircling said rotor also extends generally axially above said front face of said chipper disc and said apparatus also comprises a debris discharge duct having an inlet which opens into said wall only generally axially above the back face of said chipper disc and is constructed and arranged such that debris from the material being reduced falls onto said chipper disc and is propelled by centrifugal force into said debris discharge duct.

10. The apparatus of claim 4 which also comprises a plurality of longitudinally extending rails disposed in generally side-by-side and spaced apart relationship to each other, said rails also being disposed to extend generally longitudinally of and into a stream of chips flowing through said duct such that relatively larger chips in such stream pass over said rails and at least a portion of the relatively smaller particles in such stream pass between said rails, and at least one baffle associated with said rails and constructed and arranged to deflect at least a portion of the relatively smaller particles passing between said rails out of and away from the stream of larger chips passing over said rails, whereby the smaller particles are separated from the relatively larger chips of such material.

11. The apparatus of claim 10 wherein said rotor also comprises at least one fan blade underlying said chipper disc and constructed and arranged to produce a stream of air flowing through said discharge duct when said rotor is rotating.

12. The apparatus of claim 11 which also comprises a plurality of said baffles associated with said rails in generally spaced apart relationship to each other and constructed and arranged to cooperate with the stream of air flowing through said duct to produce a venturi effect tending to separate smaller particles from the larger chips of such material passing over said rails.

13. The apparatus of claim 1 which also comprises a wall encircling said chipper disc, lying closely adjacent thereto and extending generally axially above said front face of said chipper disc, and at least one debris discharge duct having an inlet opening into said wall generally axially above the back face of said chipper disc and being constructed and arranged such that debris from the material being reduced falls onto said chipper disc and is propelled by centrifugal force into said debris discharge duct.

14. The apparatus of claim 1 which also comprises a discharge duct through which a stream of chips of such material cut by said knife is discharged, a plurality of longitudinally extending rails disposed in generally side-by-side and spaced apart relationship to each other, said rails also being disposed to extend generally longitudinally of and into the stream of chips flowing through said duct such that relatively larger chips in such stream pass over said rails and at least a portion of the relatively smaller particles in such stream pass between said rails, and at least one baffle associated with said rails and constructed and arranged to deflect at least a portion of the relatively smaller particles passing between said rails out of and away from the stream of larger chips passing over said rails, whereby the smaller particles are separated from the relatively larger chips of such material.

15. The apparatus of claim 14 which also comprises a plurality of said baffles associated with said rails in generally spaced apart relationship to each other and constructed and arranged to cooperate with a stream of air flowing through said duct to produce a venturi effect tending to separate the smaller particles from the larger chips of such material passing over said rails.

16. The apparatus of claim 1 which also comprises a transmission having bevel gears coupled to said rotor and an input shaft with its axis of rotation inclined to the axis of rotation of said rotor.

17. Apparatus for reducing material such as felled trees, limbs, branches, and brush to chips comprising a rotor having a chipper disc with its front face extending across the feed path of such material into said rotor, at least one chipping knife disposed generally radially on and carried by said chipper disc for cutting such material into chips as said chipper disc rotates, an opening through said disc associated with said knife to permit material cut by said knife to pass through said disc, means carried by said rotor for rotation therewith and defining a pocket receiving material cut by said knife which passes through said associated opening in said chipper disc, said receiving pocket having an outlet adjacent the radially outer portion of said pocket, a rotor housing having a wall encircling said rotor, lying closely adjacent to said outlet of said receiving pocket essentially throughout the circumferential extent of said wall, and extending generally axially across at least the axial extent of said outlet of said receiving pocket, a chip discharge duct having an inlet opening through said wall of said housing and constructed and arranged to at least in part overlap said outlet of said receiving pocket when said rotor turns to sweep said outlet past said inlet of said duct such that when said inlet and outlet are overlapped at least some of the chips of material in said receiving pocket are propelled by centrifugal force into said discharge duct.

18. The apparatus of claim 17 wherein said rotor also comprises at least one generally radially and axially extending fan blade underlying said chipper disc and constructed and arranged to produce a stream of air flowing through said discharge duct when said rotor is rotating.

19. The apparatus of claim 17 wherein said rotor also comprises a second disc axially spaced apart from and underlying said chipper disc, a plurality of circumferentially spaced apart and generally axially and radially extending fan blades received between said discs and constructed and arranged to define in cooperation with said discs a plurality of blower pockets in said rotor, an air inlet associated with each blower pocket and opening through said second disc, whereby rotation of said rotor produces an airstream flowing through said discharge duct.

20. The apparatus of claim 17 which also comprises a retainer wall encircling said chipper disc, lying closely adjacent thereto and extending generally axially above said front face of said chipper disc, and at least one debris discharge duct having an inlet opening into the said retainer wall only generally axially above the back face of said chipper disc and being constructed and arranged such that debris from the material being reduced falls onto said chipper disc and is propelled by centrifugal force into said debris discharge duct.

21. The apparatus of claim 20 wherein said retainer wall is at least in part an extension of said rotor housing wall.

22. The apparatus of claim 17 which also comprises a plurality of longitudinally extending rails disposed in generally side-by-side and spaced apart relationship to each other, said rails also being disposed to extend generally longitudinally of and into the stream of chips flowing through said discharge duct such that relatively larger chips in such stream pass over said rails and at least a portion of the relatively smaller particles in said stream pass between said rails, and at least one baffle associated with said rails and constructed and arranged to deflect at least a portion of the relatively smaller particles passing between said rails out of and away from the stream of larger chips passing over said rails, whereby smaller particles are separated from the relatively larger chips of such material.

23. The apparatus of claim 22 which also comprises a plurality of said baffles in generally spaced apart relationship to each other and constructed and arranged to cooperate with a stream of air flowing through said discharge duct to produce a venturi effect tending to separate smaller particles from the larger chips of such material passing over said rails.

* * * * *